US006415126B2

(12) United States Patent
Kaneshige et al.

(10) Patent No.: US 6,415,126 B2
(45) Date of Patent: Jul. 2, 2002

(54) DEVELOPING UNIT WITH AGITATOR AND CONVEYING SHEET FOR TONER

(75) Inventors: Masatoshi Kaneshige, Nara; Yasuyuki Ishiguro, Higashiosaka; Toshio Nishino, Yamatokoriyama; Tsutomu Nagata, Hirakata; Hiroshige Araki, Yamatokoriyama; Yoshinori Otsuka, Tenri, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/752,518

(22) Filed: Jan. 3, 2001

(30) Foreign Application Priority Data

Jan. 13, 2000 (JP) ..... 2000-004250

(51) Int. Cl.[7] ..... G03G 15/08
(52) U.S. Cl. ..... 399/256; 258/263
(58) Field of Search ..... 399/256, 258, 399/263

(56) References Cited

U.S. PATENT DOCUMENTS 4,931,838 A * 6/1990 Ban et al. ..... 399/258 X
5,202,732 A * 4/1993 Yahata ..... 399/263
6,026,263 A * 2/2000 Nakahata et al. ..... 399/263
6,259,874 B1 * 7/2001 Murakami et al. ..... 399/258 X
6,289,194 B1 * 9/2001 Endo et al. ..... 399/258

FOREIGN PATENT DOCUMENTS

| | | | |
|---|---|---|---|
| JP | 4-34478 | * | 2/1992 |
| JP | 06236110 | | 8/1994 |
| JP | 7-199621 | * | 8/1995 |
| JP | 10-20668 | * | 1/1998 |
| JP | 10123815 | | 5/1998 |
| JP | 10301377 | | 11/1998 |

* cited by examiner

*Primary Examiner*—Fred L Braun

(57) ABSTRACT

A toner reserve container provided with a toner replenishing roller and a replenishing port which constitute a toner replenishing portion is arranged adjacent to a developing hopper and is provided with a toner conveying unit. The conveying unit includes an agitator rotated about a rotary shaft and a conveying sheet fixed to the agitator and scooping up and conveying toner to the toner replenishing roller. The conveying sheet has a plurality of slits formed close to the end portion where it is fixed to the agitator and extending in the direction from the end portion to the tip end of the conveying sheet. When the conveying sheet is rotated and deformed, the plurality of slits absorb rotational load to keep toner conveyed by the conveying sheet stable for a long period of time.

9 Claims, 10 Drawing Sheets

COMPARISON BETWEEN SHAPE OF CONVEYING SHEET (WITH SLITS) AND AMOUNT OF DROPPED TONER

COMPARISON BETWEEN SHAPE OF CONVEYING SHEET (WITH OPENINGS) AND AMOUNT OF DROPPED TONER

COMPARISON BETWEEN SHAPE OF CONVEYING SHEET (WITH MULTIPLE OPENINGS) AND AMOUNT OF DROPPED TONER

DEVELOPING UNIT WITH AGITATOR AND CONVEYING SHEET FOR TONER

BACKGROUND OF THE INVENTION

1. Field of the Invention

The present invention relates to a developing unit for use in an image forming apparatus such as a laser printer, a copier, facsimile machine or the like and, in particular, relates to a toner replenishing device for replenishing, as required, a developing hopper as a part of the developing unit, with the toner for image development.

2. Description of the Related Art

An image forming apparatus such as a laser printer, a copier, a facsimile machine, or the like, utilizing an electrophotographic technique, has an image forming portion for forming a desired image on a sheet for recording. In this image forming portion, the surface of a photosensitive member as an image bearer is uniformly electrified with charges of a particular polarity and then is illuminated with an optical image to form a static latent image corresponding to the image. For the purpose of visualizing this static latent image, the image forming portion includes a developing unit and other components. The developing unit is composed of developer hopper holding a developer and having a developing roller and the like for supplying the developer to the developing position where the developing roller opposes the photosensitive member. Further, since the toner in the developing hopper is consumed, the developing unit is provided, adjacent to the developing hopper, with a toner replenishing device for replenishing the developing hopper, if necessary, with the toner which is a developer.

In the developing unit described above, if the toner reserve container for replenishing the developing hopper with the developer is arranged on the top, the developing unit would be bulky as to its height and hence a waste space would arise inside the image forming apparatus, thus making the whole image forming apparatus bulky. For this reason, the toner reserve container is horizontally arranged adjacent to the developing hopper to reduce the height of the developing unit, thus making the developing unit into a low profile and at the same time making an image forming apparatus as a whole compact by eliminating the unnecessary space which would arise inside the image forming apparatus.

For example, an example of such a developing unit is disclosed in Japanese Patent Application Laid-Open Hei 10 No. 123815. A toner replenishing device has a rotatable toner conveying unit for agitating the toner and conveying the toner at the same time in a toner reserve container (toner hopper) for reserving the toner. This toner conveying unit has the function of securing the performance of conveying the toner and the function of preventing a degradation in the toner (flocculation or the like) by agitating the toner.

The toner conveying unit described above is conventionally constituted by an agitator which is a rotary member usually formed of a considerably hard material (metal, resin or the like), and firmly formed like a ladder, as disclosed in Japanese Patent Application Laid-Open Hei 10 No. 301377, for example, and a flexible conveying sheet provided at an end portion of the agitator so as to convey the toner.

As described above, since the toner reserve container is provided with the toner conveying unit made up of the agitator and the conveying sheet, the toner stored in the toner reserve container is completely conveyed without being stagnated by the above-mentioned toner conveying unit with sufficient conveyance even if the amount of the toner becomes smaller. For example, in the toner conveying unit disclosed in Japanese Patent Application Laid-Open Hei 6 No. 236110, an elastic sheet (corresponding to the conveying sheet) is provided at the tip of the agitator. The elastic sheet is put into sliding contact with the inside of the toner reserve container by rotating the agitator to sufficiently agitate and convey the toner having the tendency to accumulate on the bottom and the like. Therefore, even if the amount of toner becomes smaller, the performance of conveying the toner can be sufficiently secured and problems such as toner stagnation and the like are not presented and hence the toner can be effectively used.

Also, in the toner conveying unit disclosed in Japanese Patent Application Laid-Open Hei 10 No.301377 a ladder-shaped toner agitator provided with a rectangular film (corresponding to the conveying sheet) produces the same effect as is disclosed in the Japanese Patent Application Laid-Open Hei 6 No.236110.

Further, in Japanese Patent Application Laid-Open Hei 10 No.123815 proposed by the present inventor is also disclosed a conveying unit including an agitator and a film-shaped conveying sheet fixed to the agitator, wherein the tip end portion of the conveying sheet is in sliding contact with the inside of a toner reserve container to secure toner conveyance to stably convey the toner. In this conveying sheet, in order to further secure the toner conveyance, the tip end of the conveying sheet is bent in the rotational direction to increase the toner conveyance.

In the configuration of the conventional toner replenishing device described above, the agitator arranged in the toner reserve container is provided with the conveying sheet made of a flexible sheet or film for sufficiently securing toner conveyance even when the quantity of toner becomes smaller.

However, if the toner storage capacity of the toner reserve container is large, the toner stored in the toner reserve container can not completely be conveyed unless the conveying sheet fixed to the agitator is elongated. In this case, the strength and rigidity of the conveying sheet or the like is a big problem. For example, if a large amount of toner is stored in the toner reserve container, the conveying sheet is largely deformed to reduce the toner conveyance. To overcome the problem, it is recommended that a conveying sheet having sufficient rigidity be used, but because the conveying sheet is in sliding contact with the toner reserve container, it loses flexibility and can not be largely curved, thereby applying large load to a driving motor and to the conveying sheet itself, resulting its shorter life.

Further, the above conveying sheet is made of, for example, a polyethylene terephthalate (PET) film or a polyester film or the like so that it has good flexibility and has a tolerance against deformation and curving. For this reason, if the conveying sheet is repeatedly curved and deformed, the conveying sheet may be plastically deformed and bent and unable to reset its curvature and deformation and hence lose its toner conveying performance and its toner agitating performance.

Then, in Japanese Patent Application Laid-Open Hei 10 No. 301377 is disclosed a technique for reducing the force applied to a resin conveying sheet (film) during its rotation by making a plurality of holes in the conveying sheet fixed to an agitator. This technique can prevent the toner from applying a rotational load to the conveying sheet and, at the same time, can prevent a decrease in life caused by deformation or the like to some extent, even if the amount of toner is large.

However, it is thought that the toner conveying performance is reduced because the rigidity of the film is reduced by many holes made in the film, as described above. Also, if a plurality of holes are only made, the amount of toner conveyed by the conveying sheet is reduced as well. In particular, if many holes are formed in the portion for conveying the toner, they tend to reduce the total amount of conveyed toner.

Further, since the holes are formed uniformly in the whole area of the conveying sheet, the toner conveying performance is reduced at the tip end of the conveying sheet, whereby part of toner is left in the toner reserve container and the toner can not completely effectively conveyed.

SUMMARY OF THE INNOVATION

In view of the above problems, it is an object of the present invention to provide a toner replenishing device capable of making effective use of a toner stored in a toner reserve container and always securing a stable toner conveying performance and the sufficient amount of conveyed toner.

It is another object of the present invention to provide a toner replenishing device capable of securing a sufficient toner conveying performance only by adding a very simple configuration thereto.

In order to accomplish the above objects, a toner replenishing device according to the first invention is a toner replenishing device including a toner conveying unit for agitating and conveying a toner stored in a toner reserve container, wherein the toner conveying unit includes an agitator for rotating the toner stored in the toner reserve container and a conveying sheet fixed to the one end portion of the agitator and conveying the stored toner, wherein the conveying sheet has a plurality of slits.

Since the conveying sheet has the above configuration, even if the conveying sheet having large rigidity and strength and relatively large thickness for a conveying sheet is selected, if the above-mentioned slits are formed in the conveying sheet, the slits absorb the toner pressure applied to the conveying sheet and the load applied thereto when its tip end contacts the toner reserve container to make the conveying sheet be easily curved and deformed. For this reason, the slits can prevent an increase in torque when the conveying sheet is rotated and can make the conveying sheet secure toner conveying performance by sufficient rigidity and strength.

In the toner replenishing device according to the first invention characterized by the above-mentioned configuration, the slits are formed in the direction of the extension of the conveying sheet from the base end portion thereof where the conveying sheet is fixed to the agitator to the tip end side of the conveying sheet. Since the slits are formed in the radial direction with respect to the rotation of the agitator, they do not largely reduce the rigidity of the conveying sheet but easily deform the conveying sheet, whereby the conveying sheet can sufficiently secure the toner conveying performance and keep it throughout a long period of use.

In the toner replenishing device according to the first invention characterized by the above-mentioned configuration, the slits are formed close to the end portion where the conveying sheet is fixed to the agitator. Therefore, the conveying sheet for conveying the toner can sufficiently secure the rigidity at its tip end side and hence can stably convey the toner. In other words, since the slits are formed in the conveying sheet close to the end portion where the conveying sheet is fixed to the agitator, the conveying sheet is deformed in the portion where the slits are formed to absorb the toner pressure and the other load at the portion, thereby securing stable toner conveying performance even if it is used for a long time.

Also, in the toner replenishing device according to the first invention characterized by the above-mentioned configuration, if the slits are formed at pitches which become gradually larger from the center portion to both end portions in the direction of the rotary shaft of the agitator, the conveying sheet can secure the rigidity at its both end portions in the direction of the rotary shaft of the agitator. In other words, in the toner conveyance by the conveying sheet, the toner conveying performance tends to be reduced in both end portions as compared with the center portion. That is, the conveying sheet is largely deformed at both end portions to make the distribution of the amount of conveyed toner nonuniform in the direction of the rotary shaft. In order to correct this, if the slits are formed at pitches which become gradually larger from the center portion to both end portions, they can secure the rigidity of the conveying sheet and make the distribution of toner conveyance nearly uniform as a whole in the direction of the rotary shaft.

Further, if the slits are made gradually smaller from the center portion to both end portions in the direction of the rotary shaft of the agitator, it is possible to make the distribution of toner conveyance nearly uniform as a whole in the direction of the rotary shaft, as described above.

Also, a toner replenishing device according to the second invention to accomplish the above-mentioned objects is a toner replenishing device including a toner conveying unit for agitating and conveying a toner stored in a toner reserve container, wherein the toner conveying unit comprises an agitator for rotating the toner stored in the toner reserve container and a conveying sheet fixed to one end portion of and conveying the stored toner, wherein the conveying sheet has a plurality of openings formed close to the end portion where the conveying sheet is fixed to the agitator.

Even if a film or the like having a larger thickness for a conveying sheet is used as a conveying sheet, if it has a plurality of openings like this configuration, it can be easily deformed so as to absorb the toner pressure and the load applied thereto when its tip end contacts the inside wall of the toner reserve container and can stably convey the toner for a long time. In this case, since the openings are formed not in the tip end portion of the conveying sheet but in the portion close to the end portion thereof where the conveying sheet is fixed to the agitator, it is possible to eliminate the stagnation of the toner in the toner reserve container and to completely convey the toner. In addition, the openings can sufficiently secure the toner agitating performance and largely reduce the load applied to the conveying sheet to make it possible for the conveying sheet to be used for a long time.

In the toner replenishing device according to the second invention characterized by the above-mentioned configuration, if the plurality of openings described above have the same shape and the same opening area and are formed at pitches which become gradually larger from the center portion to both end portions in the direction of the rotary shaft of the agitator, the conveying sheet can secure rigidity at both ends in the direction of the rotary shaft. In other words, in the toner conveyance by the conveying sheet, the toner conveying performance tends to be reduced in both end portions as compared with the center portion. Therefore, the conveying sheet is largely deformed at both end portions to make the distribution of the amount of conveyed toner nonuniform in the direction of the rotary shaft. In order to correct this, if the openings are formed at pitches which become gradually larger from the center portion to both end portions, they can secure the rigidity of the conveying sheet and make the distribution of toner conveyance nearly uniform as a whole in the direction of the rotary shaft.

Further, if the openings are made gradually smaller in the opening area from the center portion to both end portions in the direction of the rotary shaft of the agitator, it is possible to make the distribution of toner conveyance nearly uniform as a whole in the direction of the rotary shaft, as described above.

Here, when the openings are formed, as shown in FIGS. 7C and 7D, for example, the number of openings is decreased in the mounting end portion where the conveying sheet is fixed to the agitator and is increased in the tip end side. Further, as shown in FIGS. 8A to 8C, in the plurality of openings, the area of the opening close to the tip end side is larger than that close to the mounting end portion. Forming the openings in this manner is effective in reducing the amount of toner scooped up by the openings of the conveying sheet having an object to convey the toner and in reducing the deformation of the conveying sheet by the toner scooped up near the tip end and in securing stable, sufficient toner conveyance. Therefore, if the plurality of openings are formed in such a way that the openings are increased in area as they get close to the tip end side from the mounting end portion where the conveying sheet is fixed to the agitator, as described above, they are useful for securing the toner conveyance.

As for the positions of the respective slits or openings in accordance with the first and second invention described above, it is recommended that the slits or the openings be formed so that the center distance h between the center position of the agitator in the direction at right angle to the rotary shaft of the agitator and the center position of the plurality of slits in the direction at right angle to the rotary shaft of the agitator and the shortest distance H between the end portion of the agitator and the bottom of the toner reserve container satisfy a relationship of $0.5H \leqq h \leqq H$. The above-mentioned center position is determined as follows: for example, in the case of the slits, as shown in FIG. 1, taking into account only the plurality of slits 60—, if the number of slits 60 is an odd number, the center in the length L of the center slit 60*c* is the center position O, and the distance from the center position O to the center of the agitator 57 is the center distance h.

Then, the distance H is the shortest distance from the one end of the agitator 57 to the bottom of the inside wall of the toner reserve container 50, as shown in FIG. 2. If the plurality of slits or openings are formed in the conveying sheet with respect to the center position O in the relationship between the center distance h and the distance H, as described above, the conveying sheet can secure good toner conveyance and keep the stable toner conveyance for a long time.

Also, in the toner replenishing device in accordance with the second invention described above, the toner conveyance depends, in particular, on the total area of the openings. In particular, if the total area of the openings increases, it naturally presents a problem of the rigidity of the conveying sheet and the like, and if it is small, the conveying sheet can not be easily deformed to be plastically deformed. For this reason, if the plurality of openings are formed so that the opening ratio Sr of the total opening area Sk of the plurality of openings to the total area Ss of the conveying sheet ($Sr=Sk/Ss\times100\%$) is set at a range from 10% to 30%, the conveying sheet can keep good toner conveyance and perform stable, sufficient toner conveyance.

As described above, according to the present invention, if the slits or openings are simply formed in the conveying sheet constituting the toner conveying unit for the purpose of conveying the toner, which is provided in the toner replenishing device, it is possible to keep stable toner conveyance for a long time. Further, if the positions of the slits or the openings are suitably determined, it is possible to produce the better effect.

DESCRIPTION OF THE PREFERRED EMBODIMENTS

Figure 1:
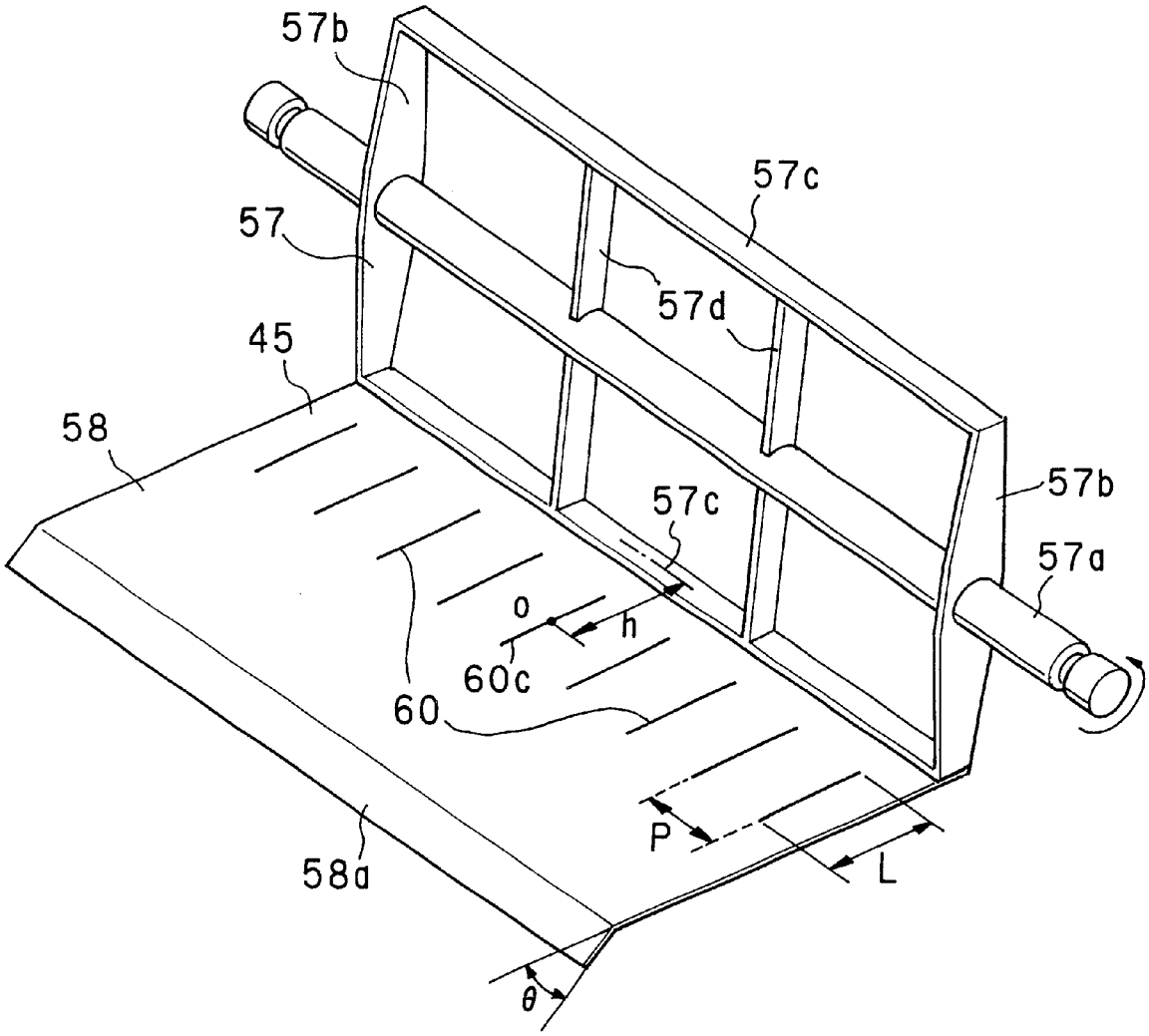
FIG. 1 is a perspective view showing an example of the configuration of a conveying sheet of a toner conveying unit constituting a toner replenishing device in accordance with the first preferred embodiment of the present invention.
Figure 2:
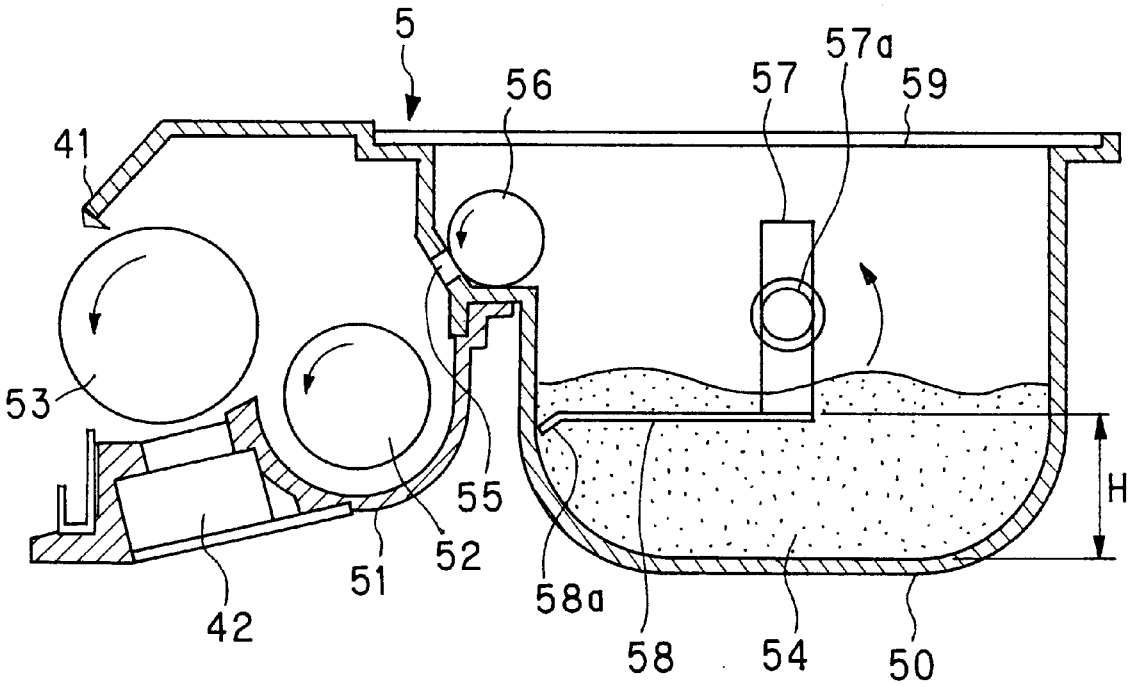
FIG. 2 is a sectional view showing the general configuration of a developing unit provided with a toner replenishing device having a toner conveying unit including a conveying sheet shown in FIG. 1.

The various embodiments of the present invention will hereinafter be described in detail with reference to the accompanying drawings. FIG. 1 is a view showing an example of a toner conveying unit constituting a toner replenishing device in accordance with the present invention, and in particular, a perspective view showing the external view of the conveying sheet in accordance with one preferred embodiment. FIG. 2 is a sectional view showing the structure of a toner replenishing device provided with a toner conveying unit shown in FIG. 1 and a developing unit provided with the toner replenishing device.

Figure 3:
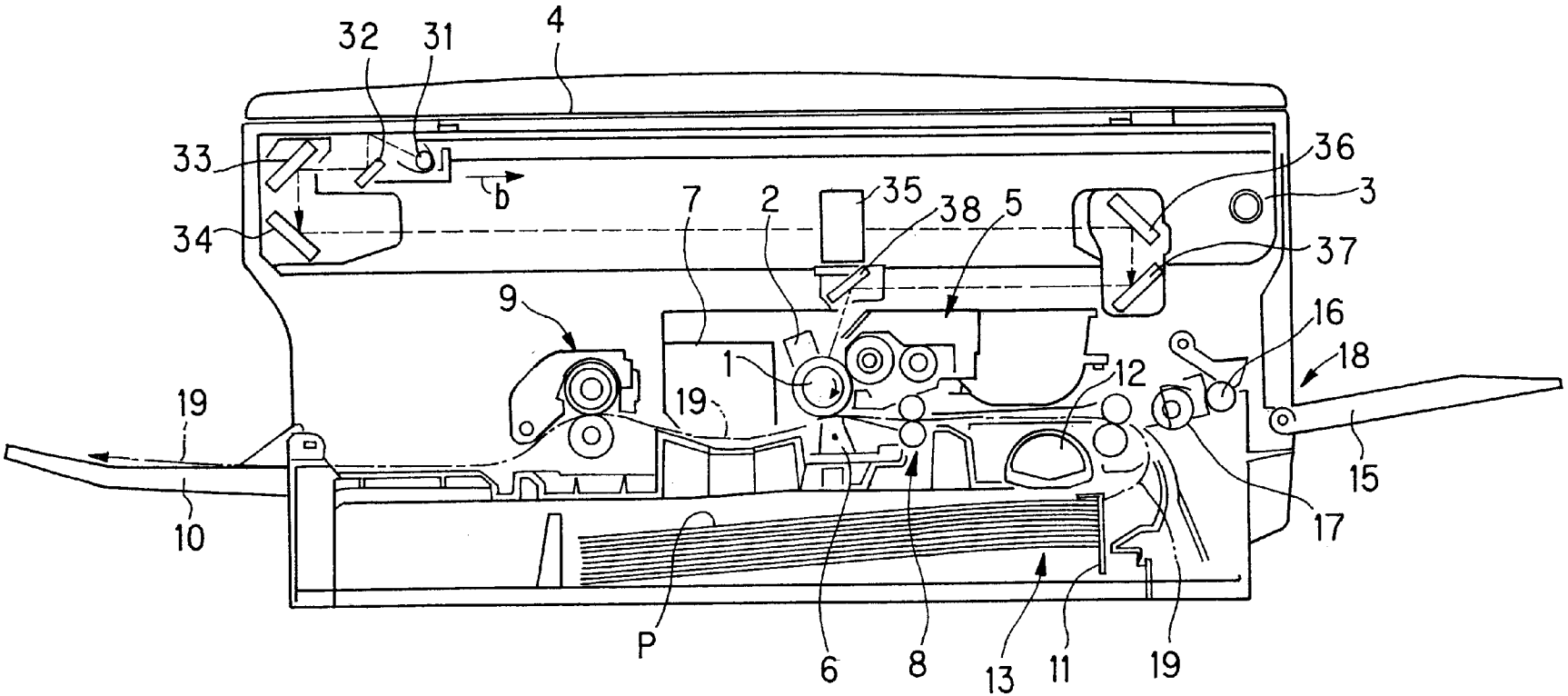
FIG. 3 is a sectional view showing an example of the general structure of an image forming apparatus provided with a developing unit shown in FIG. 2.

Also, FIG. 3 is a sectional view showing the internal structure of a copier as an example of an image forming apparatus provided with the developing unit shown in FIG. 2.

To begin with, before the description of the various preferred embodiments of a toner replenishing device in accordance with the present invention for replenishing the developing hopper of a developing unit with the toner, the image forming apparatus shown in FIG. 3 will be described. The developing unit provided with a toner replenishing device in accordance with the present invention can not only be applied to copiers but also, of course, applied as it is to the developing units of printers, facsimile machines and the like which uses electrophotography.

As shown in FIG. 3, the copier has an image forming portion composed of, in its center, a photosensitive member 1 which rotates in the direction indicated by an arrow; a charger 2 uniformly charging the surface of the photosensitive member 1; a developing unit 5 for developing the electrostatic latent image which has been formed on the photosensitive member 1 by illuminating the image of an original placed on an original table 4 through an optical system 3; a transfer device 6 for transferring the toner image formed on the surface of the photosensitive member 1 to a sheet which has been fed by a sheet feed device described below; a cleaning unit 7 for removing the toner remaining after transfer; and the like.

The optical system 3 for illuminating the photosensitive member 1 with the image of an original includes: a scanner composed of an exposure lamp 31 disposed below the original table 4 and for illuminating the original and mirrors 32, 33 and 34 which properly reflect the reflected light from the original; a lens 35 focusing the reflected light from the original onto the surface of the photosensitive member 1; and fixed reflection mirrors 36, 37 and 38 which finally lead the reflected light from the original through the lens 35 onto the photosensitive member 1. Accordingly, the first scanner portion composed of the mirror 32 and the exposure lamp 31 as the parts of the scanner is made to travel at a uniform speed along the original table 4, while the second scanner portion composed of the mirrors 33 and 34 is made to travel in the same direction as the first scanner portion but at half the speed of that of the first scanner portion. By this operation, the image of the original can be sequentially exposed slit-wise to light as photosensitive member 1 rotates, making it possible to create a focused image of the original on the surface of the photosensitive member 1.

There is also a configuration in which, instead of the optical system 3 of the above configuration, the image of an original is digitally captured by focusing the image via a focusing lens 35 on an image reading device made of a photoelectric conversion element, for example, a CCD or the like and the surface of a photosensitive member 1 is illuminated with an optical image made by a laser beam from a semiconductor laser which is selectively controlled based on the captured image data. This configuration is known as a digital copier. The configuration shown in FIG. 3 is an analog copier and distinguished from the digital copier. The present invention can be applied as it is to either of these.

When the optical system 3 exposes an original image (optical image), a static latent image in accordance with the original image is formed on the surface of the photosensitive member 1 which has been uniformly charged by the charger 2. This static latent image is developed in the next developing unit 5, where toner as a coloring agent is made to adhere to the surface of the photosensitive member 1 so as to create a visual image.

The toner image created on the surface of the photosensitive member 1 is transferred by the action of a transfer device 6 to a sheet which is being conveyed appropriately from a sheet feed device. The sheet has been previously conveyed up to the position of a registration roller 8, and is delivered out by the registration roller 8 to a transfer station (image forming station) facing a transfer. device 6, at the timing in synchronization with the rotary movement of the photosensitive member 1.

The sheet after transfer is separated from the surface of the photosensitive member 1 and then is conveyed along the guide surface to a heat fixing roller 9. As it passes through the heat fixing roller 9, the toner image formed on the sheet is fixed as a permanent image. Thereafter, the sheet is discharged onto a sheet output tray 10 which is projected out from a copier body.

Next, the sheet feed device for feeding sheets to the registration roller 8 will be described. The sheet feed device includes: a cassette feeder portion 13 which is disposed in the lower part of the copier body and includes a sheet feed roller 12 for delivering sheets P stored in a sheet cassette 11 which can be detachably fitted to the machine body (can be withdrawn to the front side in the drawing); and a manual paper feeder 18 having a sheet tray 15 on which a multiple number of sheets P can be placed and being composed of a pickup roller 16 over and opposing the tray, and a sheet feed roller 17 for separating and feeding the sheet P delivered by the pickup roller 16.

In the figure, a reference number 19 shows the conveyance path of a sheet P fed from the sheet feeder device, in particular, from the cassette feeder portion 13.

Next, description will be made of one embodiment of the developing unit 5 in accordance with the present invention in which the performance of the toner replenishing device to convey the toner to the toner replenishing portion is improved.

The First Preferred Embodiment of the Invention

FIG. 2 shows the configuration of a developing unit 5 in accordance with the first preferred embodiment of the present invention as stated heretofore. In FIG. 2, the developing unit 5 has a toner replenishing device having a toner reserve container 50 storing the toner. This toner reserve container 50 is horizontally arranged at the side of a developing hopper 51 as a part of the developing unit 5.

As conventionally known, the developing unit 5 is provided respectively with a rotatable, agitating roller 52 for agitating and conveying the developer stored in the developing hopper 51 and a rotatable, developing roller 53 for conveying the developer to the developing area facing the image forming portion shown in FIG. 3, in particular, the photosensitive member 1, so as to perform development. The aforementioned toner reserve container 50 is arranged adjacent to the developing hopper 51.

Though not illustrated, when the developer is comprised of a toner and a carrier, the developing roller 53 is constituted by a cylindrical, non-magnetic sleeve and a magnet assembly having a plurality of magnetic poles accommodated therein. As the sleeve is rotated counterclockwise as shown in FIG. 2, the developer attracted by the magnetic force of the magnet assembly is conveyed in the counter-clockwise direction into the developing area facing the photosensitive member 1. A regulating blade 41 for limiting the amount of the developer adhering to the developing roller 53 is provided at a position midway through conveyance while keeping a certain distance from the sleeve surface.

On the other hand, the toner reserve container 50 constituting the developing unit in accordance with the present invention is a container for storing a toner 54 to be supplied to the developing hopper 51 as required. A supplying port 55 through which the toner 54 is supplied is formed between the toner reserve container 50 and the adjacent developing hopper 51. A toner replenishing roller 56 is rotatably arranged in such a way that part of the peripheral surface thereof is pressed against the rim of the opening of the supplying port 55. These two supplying port 55 and replenishing roller 56 constitute the replenishing portion.

The toner replenishing roller 56 is formed of a porous material such as sponge or the like so that a large number of pores can be formed on its peripheral surface to retain the toner 54 to be supplied to the developing hopper 51. Therefore, as toner replenishing roller 56 rotates, the roller surface is scraped by the rim of the supplying port 55 so that the toner 54 retained by the toner replenishing roller 56 is scraped off and supplied to the developing hopper 51.

In order to supply the toner 54 to the toner replenishing roller 56, a toner conveying unit is arranged inside the toner reserve container 50. This toner conveying unit is provided with a rotatable agitator 57 which is a rotatable member (rotator). The agitator 57 is rotationally driven about a rotary shaft 57*a* so as to agitate mainly the toner 54 stored in the toner reserve container 50. This agitator 57 is a type which is conventionally known and has no special structure.

Describing one example of the structure of this agitator 57 with reference to FIG. 1, a pair of supporting plates 57*b* are arranged near both ends of the rotary shaft 57*a* with agitating bars 57*c* for connecting both ends of both the supporting plates 57*b*. In FIG. 1, a plurality of ribs 57*d* for reinforcement are disposed between the rotary shaft 57*a* and the agitating bars 57*c*. The rotary shaft 57*a* is not required to be a single bar but may be projected from both end surfaces of the supporting plates 57*b*, as described in Japanese Patent Application Laid-Open Hei 10 No. 301377. These members may be integrally formed of the same material.

As illustrated in FIG. 2, the rotary shaft 57*a* of the agitator 57 is positioned at the approximate center of the toner reserve container, with respect to the height (the vertical direction). When the rotary shaft 57*a* is rotated, the agitator 57 is rotated. Fixed to at least one side of the agitator 57, in particular, to the agitating bar 57*c* side, is one end of a conveying sheet 58, which is made up of a sheet-like flexible member and agitates the toner 54 in the toner reserve container 50 and brings (conveys) the toner 54 into the replenishing roller 56. It is of course possible to attach a pair of conveying sheets 58 to both of the aforementioned agitating bars 57*c* on both sides of the agitator 57. This conveying sheet 58 and the agitator 57 constitute a toner conveying unit.

Now, the featured configuration of the conveying sheet 58 in accordance with the present invention will hereinafter be described in detail. This conveying sheet 58 is composed of a film sheet having a thickness of 0.25 to 0.5 mm such as a polyethylene terephthalate (PET) film, a polyester film, or the like. And the conveying sheet 58 has a toner holding portion 58*a* bent at an angle θ at the tip end of the free end side so as to secure the toner conveyance and a sufficient amount of conveyed toner as shown in FIG. 1. In the present invention, the toner holding portion 58*a* may be provided as required and is not the essential requirement of the present invention.

The length of the above-mentioned conveying sheet 58 is set long enough so that its tip end is put into sliding contact with the inside wall of the toner reserve container 50, as shown in FIG. 2. Therefore, the conveying sheet 58 can agitate and convey the toner stored without stagnation. In particular, according to FIG. 2, the toner reserve container 50 are long in the lateral direction and the conveying sheet 58 contacts the bottom surface of the toner reserve container 50, which results in increasing the deformation of the conveying sheet.

In this connection, in FIG. 2, a reference number 59 designates a lid which can be opened or closed so as to replenish the toner reserve container 50 with the toner. This lid 59 is opened so as to mount a toner cartridge and is closed after the toner reserve container 50 is replenished with the toner and the cartridge is removed after replenishment. Also, a reference number 41 designates a regulating blade for limiting the amount of developer adhering to the developing roller 53 to a given quantity and a reference number 42 designates a concentration sensor for detecting the amount of toner contained in the developer, that is, a toner concentration by a change in magnetic permeability. The toner replenishing action is performed according to the detection of this concentration sensor.

The conveying sheet in accordance with the present invention is made thicker than a conventional conveying sheet. The conventional conveying sheet is so thin that it can be largely deformed and curved when it contacts the inside wall of the toner reserve container 50. For example, the thickness of the conventional conveying sheet is about from 0.125 mm to 0.188 mm. Accordingly, the thickness of the conveying sheet 58 in accordance with the present invention is about from 1.33 to 4 times that of the conventional conveying sheet.

When the agitator 57 rotates, the conveying sheet 58 having such a thickness is turned while its tip end portion is being put into sliding contact with the inside wall of the toner reserve container 50, agitating the toner 54 stored, scooping up and conveying it by its tip end portion. Here, the conveying sheet 58 has such a sufficient thickness that secures its rigidity to thereby make it possible to agitate the toner sufficiently and to increase the amount of toner to be scooped up and conveyed (to secure a sufficient amount of conveyance).

However, if the conveying sheet 58 increases in thickness, when the conveying sheet 58 slides over the inside wall of the toner reserve container 50, the load applied thereto increases and the conveying sheet 58 tends to be prevented from being curved and deformed. This makes the amount of toner to be conveyed unstable and increases driving load (rotational torque). In order to prevent this, in the present invention; a plurality of slits 60 shown in FIG. 1 are made in the conveying sheet 58. The slits 60 are formed from the base end (near root) where the conveying sheet 58 is fixed to the agitator 57 toward the free end side of the conveying sheet 58.

The slits 60 formed in the conveying sheet 58 in this manner can decrease the rigidity (bending strength) of the conveying sheet 58 at the portion where it is fixed to the agitator 57. This can decrease resistance (load) produced when the conveying sheet 58 is turned while being in sliding contact with the inside wall of the toner reserve container 50 and hence can prevent an increase in the driving load.

In other words, the conveying sheet 58 is made to be easily deformed near the portion where it is fixed to the agitator 57 and can be easily curved and deformed by the resistance of the toner 54 which is stored and by the resistance of the inside wall of the toner reserve container 50. Here, since the tip end portion, or the free end portion, of the conveying sheet 58 has rigidity due to the sufficient thickness, the conveying sheet 58 can secure sufficient toner conveyance and sufficient volume of conveyed toner.

Further, the plurality of slits 60 can decrease the pressure of the toner applied to the conveying sheet 58 and can secure the sufficient amount of toner conveyance without applying excessive stress to the agitator 57 and the toner 54. In particular, the amount of toner stored in the toner reserve container 50 is not always uniformly distributed in the longitudinal direction (in the direction of rotary shaft of the agitator 57). However, according to the conveying sheet 58 having slits 60 in accordance with the present invention, the amount of deformation of the conveying sheet 58 is apt to be large in the area where the amount of toner is large by the resistance of the toner and hence the conveying sheet 58 can absorb resistance against the toner. This can prevent the conveying sheet 58 from applying excessive stress to the toner and hence can secure stable toner conveyance. As described above, in the toner replenishing device in accordance with the first preferred embodiment of the present invention, in the case where the thickness of the conveying sheet 58 turned in the toner reserve container 50 storing (accommodating) the toner 54 is considerably thick, the slits 60 made in the conveying sheet 58 can appropriately set the rigidity of the conveying sheet 58. For this reason, this eliminates the need of reducing the thickness of the conveying sheet like the conventional conveying sheet and can convey a sufficient amount of conveyed toner.

A thin conveying sheet like the conventional conveying sheet needs to be equipped with a reinforcing member, for example, so as to secure sufficient conveyance, whereas the conveying sheet 58 in accordance with the first preferred embodiment of the present invention can secure the larger toner conveyance than ever and can stably convey the toner only by forming the slits 60 therein.

Further, since the slits 60 are formed near the portion where the conveying sheet 58 is fixed to the agitator 57, the conveying sheet 58 can be largely deformed near the portion. For this reason, even if the number of the slits 60 is reduced, the amount of deformation of the conveying sheet 58 can be made large, which prevents an increase in cost. In other words, when the slits 60 are formed at small spacings, in some case, it not only takes much labor but also the slits 60 can not be successfully formed in the shape of straight slits because adjacent slits affect each other when the slits are formed. However, according to the present invention, the slits 60 can be formed at sufficient large spacings and hence does not increase manufacturing cost.

Other Embodiments of the Conveying Sheet in Accordance with the First Preferred Embodiment As shown in FIG. 1, the slits 60 made in the conveying sheet 58 in accordance with the present invention have the same pitch P and the same length L. Instead of this shape, the slits 60 may be formed in the other shapes as shown in FIG. 4.

The shapes of the slits 60 shown in FIG. 4 can have a sufficient effect on further stabilizing the toner conveyance. That is, since the tip end area of the conveying sheet 58 is easily deformed as compared with the center area. Therefore, taking the toner conveyance into account, the amount of conveyed toner tends to become less in both end areas than at the center area.

Figure 4A:
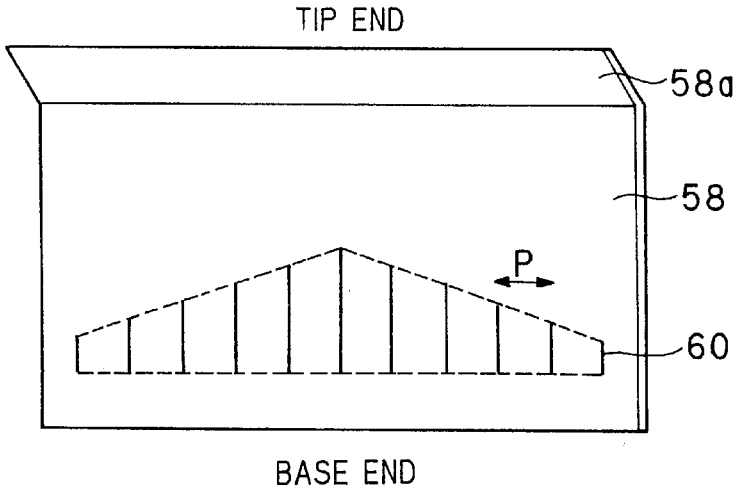
FIGS. 4A to 4C are views showing other various examples of a conveying sheet in accordance with the first preferred embodiment of the present invention.
Figure 4B:
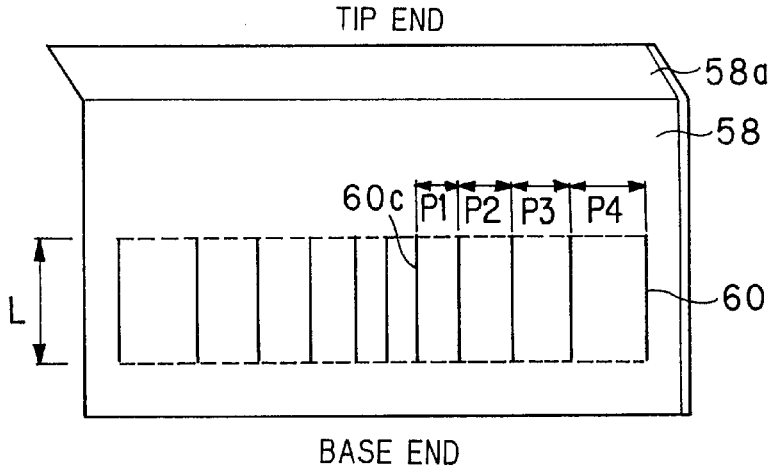
Figure 4C:
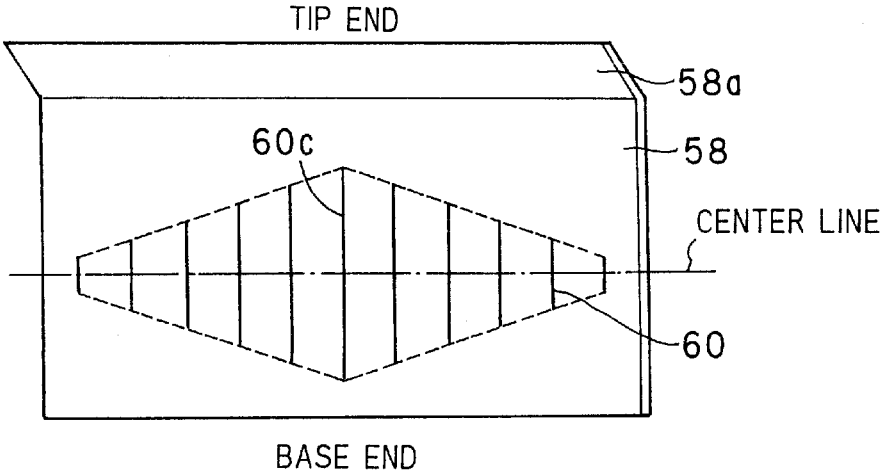

Therefore, taking this into account, it is recommended that the slits 60 be formed in the shape shown in FIGS. 4A to 4C so as to nearly uniform the toner conveyance and the amount of conveyed toner in the direction of the rotary shaft 57*a* (FIG. 1).

To begin with, according to FIGS. 4A and 4C, the slits 60 are made longer in the center area than in both end areas. In particular, the slits 60 shown in FIG. 4A are made gradually shorter in length with respect to the end portion where the conveying sheet 58 is fixed to the agitator 57 as they are near to both end sides in the direction of the rotary shaft 57*a*. Here, the pitches P of the slits 60 are made equal to each other in the direction of the rotary shaft 57*a*.

Also, the slits 60 shown in FIG. 4C are made gradually shorter in length of ups and downs with respect to the center line (which is parallel to the rotary shaft 57*a*) of a reference slit 60*c* at the center of the conveying sheet 58 as they are near to both ends.

In the conveying sheet 58 having slits 60 formed in this manner, the rigidity thereof is reduced in the center area to be nearly equal to the rigidity in the end area. This can prevent the toner conveyance by the conveying sheet 58 from being decreased in both end areas to maintain the same toner conveyance in both end areas as in the center area. In this manner, it is possible to roughly uniform the distribution of the amount of toner conveyed by the conveying sheet 58 in the direction of the rotary shaft 57*a* and to secure stable toner conveyance.

Further, according to the configuration of the slits 60 shown in FIG. 4B, the slits 60 are equal to each other in length L and the spacings (pitch P) of the slits 60 are made gradually longer toward the end portions from the slit 60*c* at the center. In other words, the spacings (pitches P) are formed so that $P1<P2<P3$ - - - as the slits 60 are near to both end portions from the slit 60 at the center. The slits 60 formed in this manner can also increase the rigidity of the conveying sheet 58 at both end portions to make the rigidity at both end portions equal to the rigidity at the center. In this way, the slits 60 having the configuration shown in FIG. 4B can produce the same effect as the slits 60 having the configurations shown in FIGS. 4A and 4C.

Figure 5A:
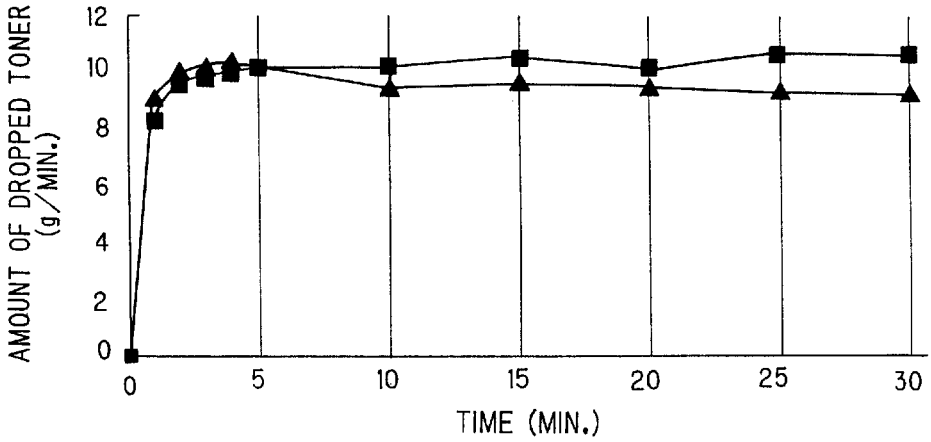
FIGS. 5A to 5C are the characteristic charts showing, for comparison, the results of the toner conveyance of conveying sheets in accordance with the present invention.

A comparison of the conveying sheet 58 having slits 60 in accordance with the first preferred embodiment of the present invention described above and a conveying sheet having no slits was made and characteristic charts concerning the results of the comparison will be shown in FIG. 5A.

Here, as the conveying sheet 58 in accordance with the present invention shown in FIG. 5A was used a polyester film having a thickness of 0.25 mm and slits 60 formed at equal intervals (equal pitches P) and the same length L, as shown in FIG. 1. Also, when a center distance h is defined from the center position O of the slit 60 to the center of the agitator 57 as shown in FIG. 1, and the shortest distance H is defined from the end portion of the agitator 57 to the bottom of the toner reserve container 50, as shown in FIG. 2, the slits 60 were formed so that $h=0.7H$.

The center position O described above means the center of the group of slits 60 when only the group of slits is taken into account. For example, if the number of slits is odd, as shown in FIG. 1, the center position O is the center in the length L of the center slit 60*c*. Also, if the length L and the pitch P of the slits are the same as those described above and the number of slits are even, the center position O is the center between two neighboring center slits and of length L.

Figure 6:
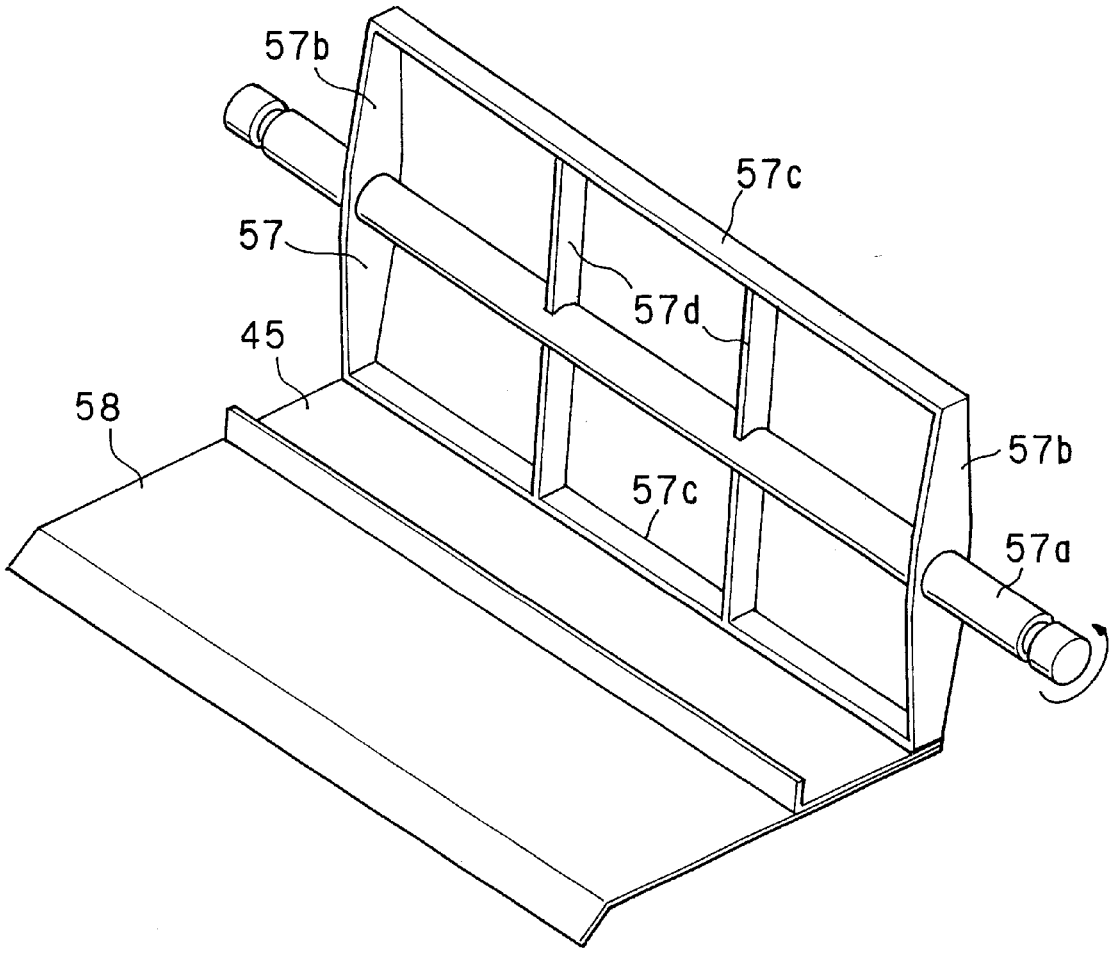
FIG. 6 is a perspective view showing the configuration of a toner conveying unit having a conveying sheet provided with a reinforcing member, as a comparative example of a conveying sheet constituting the toner conveying unit in accordance with the present invention.

As a comparative conveying sheet 58 was used a polyester film having a thickness of 0.125 mm so that it was put into sliding contact with the inside wall of the toner reserve container 50 and could be curved. Also, this comparative conveying sheet was provided with a reinforcing member fixed to the agitator 57 and having a length shorter than the conveying sheet. For example, as shown in FIG. 6, a thinner conveying sheet 58 is provided on the agitator 57 via a reinforcing member 45.

Also, the toner reserve container 50 was packed with a predetermined amount of toner 54 and then the agitator 57 was continuously rotated to supply the toner 54 to the developing hopper 52 side via the toner replenishing roller 56. The amount of toner 54 fed to the developing hopper 52 side was measured. The measurement results will be shown in FIGS. 5A to 5C, where the time (minute) of rotation of the conveying sheet is plotted in horizontal axis and the amount of supplied toner is plotted as the amount of dropping of toner in vertical axis.

Here, the amount of conveyed toner will be shown in FIG. 5A, where the amount of conveyed toner for the conveying sheet 58 provided with the reinforcing member 45 will be plotted with a mark ▼ and that for the conveying sheet 58 with slits 60 having the structure shown in FIG. 1 in accordance with the present invention will be plotted with a mark ■. As clearly shown in FIG. 5A, the conveying sheet 58 in accordance with the present invention could secure a stable toner conveyance for a long period and a sufficient amount of replenished toner.

Further, the conveying sheet 58 provided with the reinforcing member 45 could keep stable toner conveyance, but the conveying sheet 58 in accordance with the present invention was slightly superior in the amount of conveyed toner to the conveying sheet 58 provided with the reinforcing member 45 and could keep the same toner conveyance for a long period as the conveying sheet 58 provided with the reinforcing member 45.

In conclusion, the conveying sheet 58 having the slits 60 in accordance with the present invention could secure the same toner conveyance as the conveying sheet provided with the reinforcing member 45 shown in FIG. 6. In addition, this eliminates the need for providing the conveying sheet 58 with the reinforcing member, making the structure of the toner conveying unit simple, and reducing costs.

The Second Preferred Embodiment of the Present Invention

The conveying sheet 58 having slits 60 has been described based on the preferred embodiment described above. This can reduce resistance against the toner and the toner reserve container 50 and increase the amount of conveyed toner and keep the toner conveyance for a long period, even if the conveying sheet 58 is thick.

Another preferred embodiment of the conveying sheet 58 to accomplish such an object and effect will hereinafter be described. In this preferred embodiment, the conveying sheet 58 has openings instead of the slits 60. That is, the conveying sheet 58 in accordance with the second preferred embodiment of the present invention has various openings, as shown in FIGS. 7A to 7D, which are formed close to the base end portion where the conveying sheet 58 is fixed to the agitator 57.

Figure 7B:
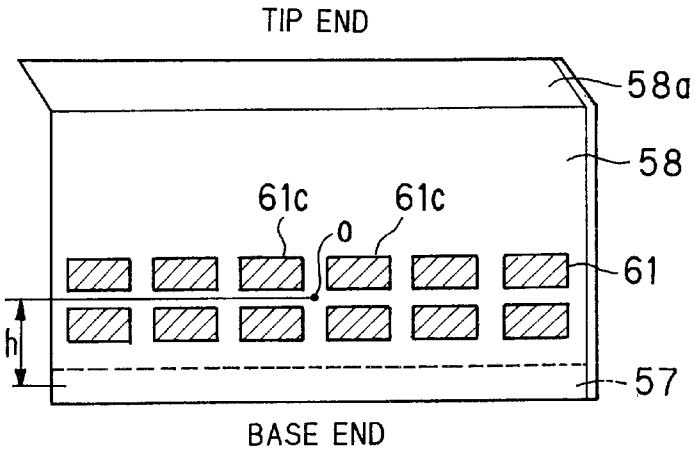
FIGS. 7A to 7D are plan views showing various embodiments of a conveying sheet constituting a toner conveying unit in accordance with the second preferred embodiment of the present invention.
Figure 7A:
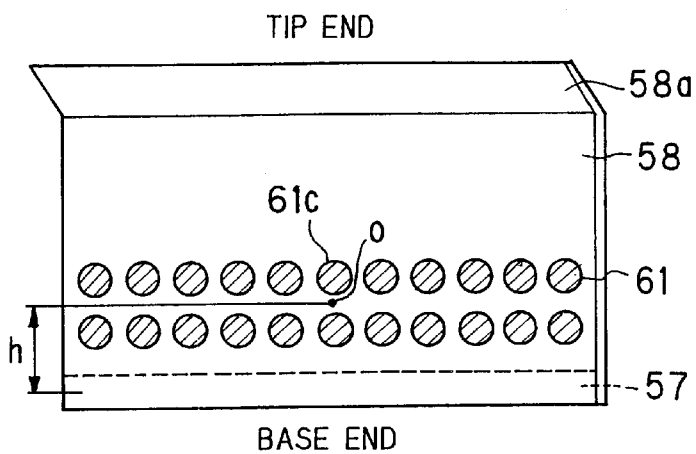

To begin with, the conveying sheet 58 shown in FIG. 7A has a plurality of circular openings 61. These circular openings 61 are formed close to the base end portion where the conveying sheet 58 is fixed to the agitator 57, as described above, and in two rows parallel to each other (two rows in the direction of length or the rotary shaft 57*a*). Also, the conveying sheet 58 shown in FIG. 7B has a plurality of rectangular openings 61 similarly formed in two rows. These openings 61 formed in the conveying sheet 58 have thy same spacing (pitch) and the same size (area S). In addition, the two rows of openings 61 are aligned at the same positions.

Figure 7D:
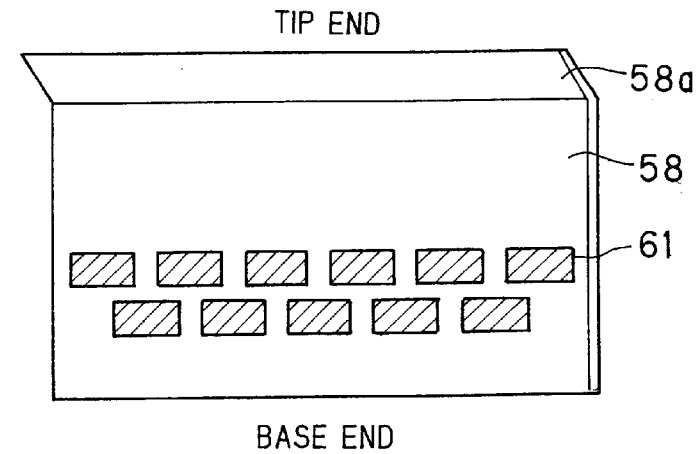
Figure 7C:
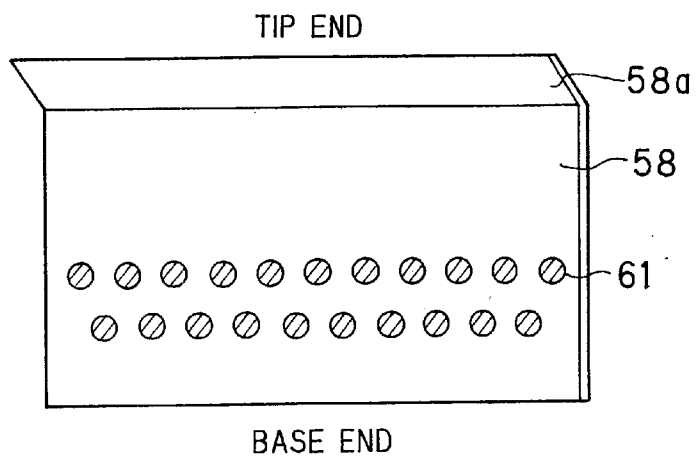

On the other hand, the openings 61 shown in FIGS. 7C and 7D are shifted in positions with each other in two rows. In other words, the openings 61 are formed in a staggered arrangement. In this case, the number of the openings 61 in a row close to the base end side is smaller than that in a row close to the tip end side. In this connection, although the opening 61 is shaped like a circle or a rectangle in FIG. 7, the shape of the opening 61 is not limited to these but it may be shaped like a triangle or a polygon such as a pentagon.

In the configuration like this, even if the conveying sheet 58 having a thickness of about 0.5 mm, for example, is used, if it has various kinds of openings 61 shown in FIG. 7, it can be expected to produce the same effects as the conveying sheet 58 having the slits 60. That is, since. the conveying sheet 58 has a plurality of openings 61, when the conveying sheet 58 is put into sliding contact with the inside wall of the toner reserve container 50, it is easily curved and bent and hence can effectively convey the stored toner 54 while securing the sufficient rigidity by the use of the tip end portion of the conveying sheet 58. Here, the extra toner slips through the openings 61 to reduce a rotational torque, thereby effectively agitating the toner itself including the one slipping through the openings 61.

The toner conveyance was evaluated by using the conveying sheet 58 having the openings 61 shown in FIG. 7B, as is the case with the conveying sheet 58 having the slits 60. In this case, the ratio of opening Sr, that is, the ratio obtained by dividing the total area Sk of the openings 61 by the total area Ss of the conveying sheet 58 ($Sk/Ss \times 100\%$) was set at 25%, where the total area Ss of the conveying sheet 58 is the area obtained by removing the area of a toner holding portion 58*a* at the tip end portion and the end portion to which the agitator 57 is fixed on the conveying sheet 58.

The openings 61 were formed so that letting a distance from the center O of only the group of the openings 61 to the center of the agitator 57 to which the conveying sheet 58 is fixed be h and the shortest distance from the tip of the agitator 57 to the bottom of the toner reserve container 50 be H, h=0.7H. Also, as a comparative conveying sheet 58 was used a conveying sheet 58 having a thickness of 0.125 mm and provided with a reinforcing member 45 shown in FIG. 6. The toner conveyance was evaluated for the conveying sheet 58 in accordance with the present invention and the comparative one and the results of comparison will be shown in FIG. 5B.

Figure 5B:
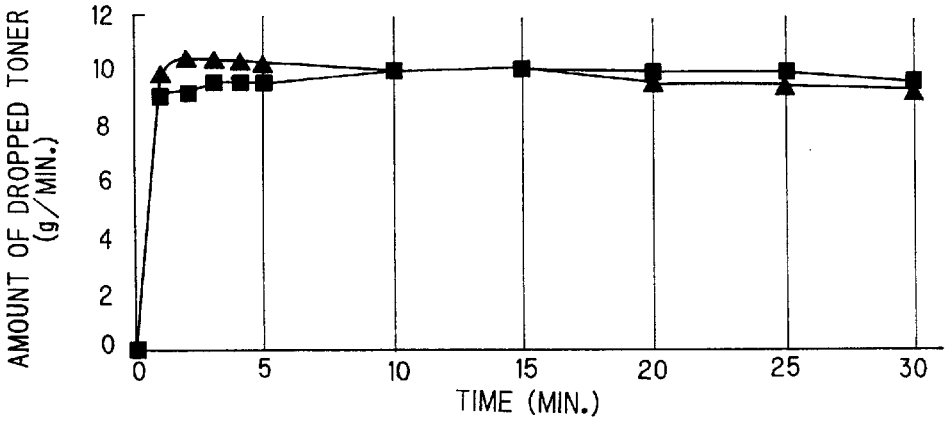

As shown in FIG. 5B, the conveying sheet 58 having the openings 61 could secure the toner conveyance and stably keep sufficient amount of conveyed toner for a long period as well. In this case, the conveying sheet 58 having the openings 61 could secure the approximately same toner conveyance as the conveying sheet 58 provided with the reinforcing member 45 and could keep the toner conveyance for a long period. In this connection, although the performance of agitating the toner can not be understood in FIG. 5, the toner was sufficiently agitated and was not observed to flocculate. As for only the performance of agitation, the conveying sheet having the openings 61 like this produced the good effects as compared with the conveying sheet having the slits 60 and reduced the rotational torque necessary for rotating the agitator 57.

Figure 5C:
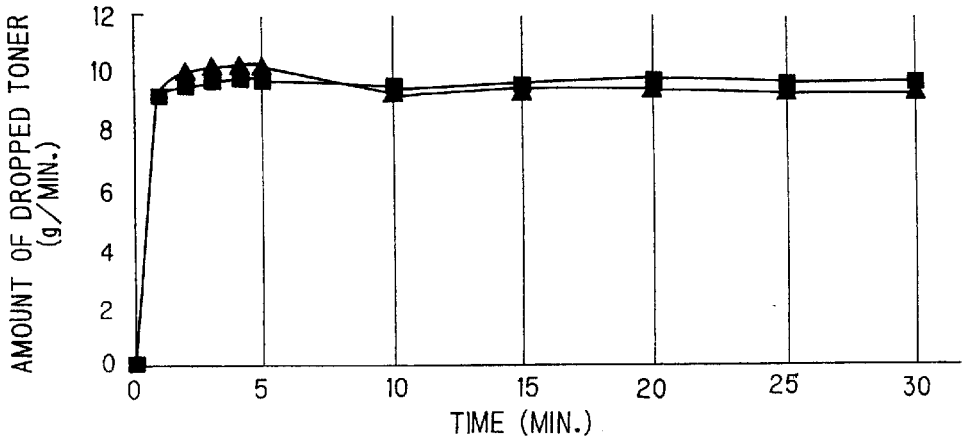

Also, the results of evaluation for the conveying sheet 58 having the openings 61 shown in FIG. 7A will be shown in FIG. 5C. In this case, the ratio of opening was set at 25% and the center distance h was set at 0.77H. Here, the center position O is the center position of only the group of openings 61, as the case with the conveying sheet 58 having the slits 60. For example, in FIG. 7A, if the openings 61 are formed in two rows and the number of openings 61 formed in one row is an odd number, the center position O is positioned at the center between the center openings 61*c*. If the number of the openings 61 formed in one row is an even number, as shown in FIG. 7B, the center position O is at the center between two neighboring center openings 61 and between the two rows.

The evaluation results of the toner conveyance for the conveying sheet 58 having the openings shown in FIG. 7A and the conveying sheet provided with the reinforcing member 45 shown in FIG. 6 will be shown in FIG. 5C. The conveying sheet 58 having the configuration shown in FIG. 7A could keep the toner conveyance for a long period as the case with conveying sheet having the configuration shown in FIG. 7B.

Other Embodiments in Accordance with the Second Preferred Embodiment of the Present Invention In the second preferred embodiment in accordance with the present invention, the openings 61 of the same shape were simply formed in the conveying sheet 58. Instead of this openings 61 formed in two rows, openings 61 of the other shapes will be shown in FIG. 8. The conveying sheet having the openings shown in FIG. 8 is expected to produce the same effects as well.

Figure 8A:
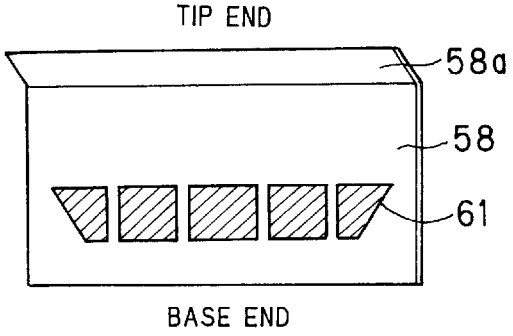
FIGS. 8A to 8E are plan views showing other various embodiments of a conveying sheet constituting a toner conveying unit in accordance with the second preferred embodiment of the present invention.
Figure 8B:
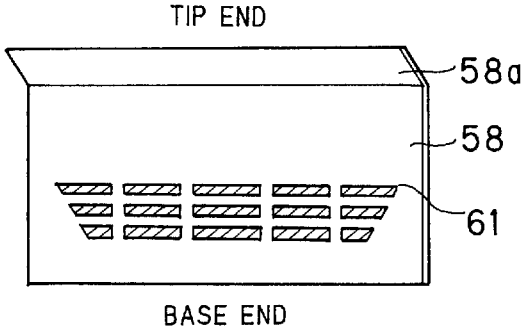
Figure 8C:
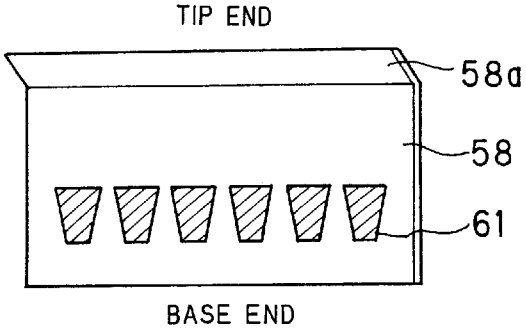

The openings 61 shown in FIGS. 8A and 8C are formed in one row and are made to have a large opening area near the toner agitating conveying side or the tip end side of the conveying sheet. Also, the openings 61 shown in FIG. 8B are formed in three rows to increase the total opening area near the tip end side of the conveying sheet 58 for agitating and conveying the toner as the case shown in FIGS. 8A and 8C.

The openings 61 having a configuration like this can produce the same effects as those shown in FIGS. 7C and 7D. In other words, these openings 61 are effective in reducing the amount of toner scooped up at the openings 61 of the, conveying sheet to have an object of conveying the toner and reducing the deformation of the conveying sheet by the toner scooped up near its tip end, thereby effectively securing the stable, sufficient performance of conveying the toner. For this reason, if a plurality of openings are formed in the conveying sheet and increase the opening area as they get closer to the tip end from the base end where the conveying sheet is fixed to the agitator, as described above, they are useful for securing the toner conveyance.

Figure 8D:
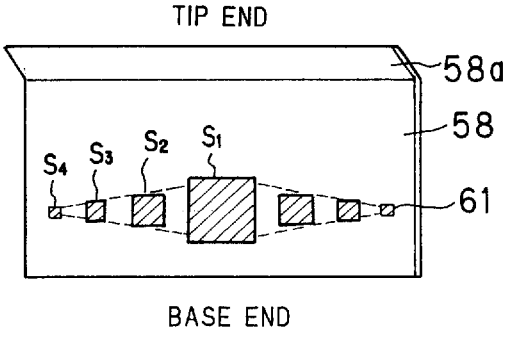
Figure 8E:
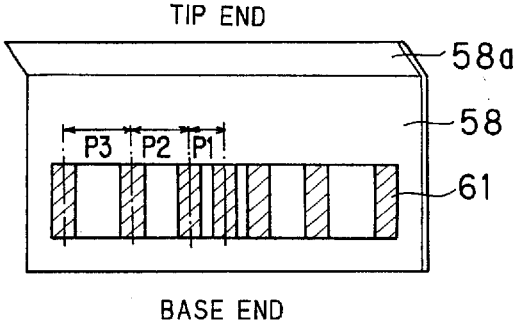

Also, the conveying sheet 58 having the openings 61 shown in FIGS. 8D and 8E can have the sufficient effect of making the toner conveyance further stable. In other words, the tip end region of the conveying sheet 58 is easily deformed as compared with the center region thereof and hence the amount of conveyed toner tends to decrease in both the tip end regions as compared with the center region because of the toner conveyance.

Therefore, taking into account this situation, it is recommended that the openings 61 be formed in the shapes shown in FIGS. 8D or 8E so as to approximately uniform the toner conveyance and the amount of conveyed toner in the direction of the rotary axis 57*a*.

In particular, the openings 61 shown in FIG. 8D are formed in one row and the area of the opening at the center is maximum and the area of the opening becomes gradually smaller as the opening gets closer to both end sides. In other word, letting the area of the opening 61 at the center be Si and the areas of the openings near both sides be S2, S3, - - - , the relationship of S1>S2>S3 - - - is established. These openings 61 can reduce the rigidity at the center region of the conveying sheet 58 to make it nearly equal to that at both end regions. This prevents the toner conveyance by the conveying sheet 58 from decreasing at both end sides to keep the same conveyance that is produced at the center region. This can make the distribution of the amount of toner conveyed by the conveying sheet 58 uniform in the direction of the rotary shaft 57*a* and can secure the stable toner conveyance.

Also, the openings 61 formed in the conveying sheet 58 shown in FIG. 8E are formed similarly in one row, in the same shape and the same area, and the spacings between them (pitches P) become gradually longer as they get closer to the ends from the center. In other word, letting the pitch between the opening 61 at the center and its neighboring opening 61 be P1 and the pitch of the neighboring opening 61 be P2 and so on, the relationship of P1<P2<P3 - - - is established. These openings 61 can increase the rigidity of the conveying sheet 58 at both end portions to make it nearly equal to the rigidity at the center as the case with the slits 60 shown in FIG. 4B. This can produce the same effect as the opening 61 shown in FIGS. 8D and 8E.

Here, since the openings 61 shown in FIG. 7 and FIGS. 8C, 8E have the same shape and the same area, forming these openings is easier that forming the openings having different shapes. Further, if the openings have the same shape and the same area, it is easy to set opening density and the like in relation to the deformation of the conveying sheet 58. Still further, it is easy to determine the number of openings, the opening density and the like in relation to the deformation of the conveying sheet 58.

Verification of Effect Relative to the Position Where Slits and Openings are Formed As described above in the first and second preferred embodiments, the conveying sheet 58 having the slits 60 or the openings 61 is expected to produce the same or more effect as the conveying sheet provided with the reinforcing member shown in FIG. 6.

Here, the effect of the toner conveyance varies with the positions of the slits 60 or the openings 61. In particular, if the slits 60 or the openings 61 are formed close to the tip end portion of the conveying sheet 58 (near the toner holding portion 58*a*), they reduce the toner conveyance and if they are formed close to the base end portion where the conveying sheet 58 is fixed to the agitator 57, they increase the deformation of the conveying sheet 58 to similarly reduce the toner conveyance.

Hence, the preferred embodiments relating to the positions where the slits 60 or the openings 61 are formed will be described. In this preferred embodiment, the openings 61 are formed in the conveying sheet 58 in two rows and in the shape shown in FIG. 7A. The conveying sheet 58 was made of a polyester film having a thickness of 0.5 mm.

In particular, the opening ratio of the openings 61 was set at 25%, as described above. In the opening ratio, the center position O is the center of the group of openings 61, that is, the center between the openings 61*c*. The amount of conveyed toner (the amount of dropped toner) was measured by using the conveying sheets 58 having various center distance h, the distance h being from the center position O of the group of openings 61 to the center of the agitator 57 provided with the conveying sheet 58.

Then, the results of measurement of the amount of conveyed toner (the amount of dropped toner) when the above-mentioned distance h was varied to 0.45H, 0.5H. 0.75H, 1.0H, and 1.05H will be shown in FIGS. 9A to 9E, where the H is the shortest distance from one end of the agitator 57 to the bottom of the toner reserve container 50, as shown in FIG. 2. Also, in FIGS. 9A to 9E, as a comparative example was used a conveying sheet 58 made of a polyester film having a thickness of 0.125 mm and provided with the reinforcing member 45 shown in FIG. 6. In FIGS. 9A to 9E, the measurement results of the conveying sheet in accordance with the present invention is plotted with a mark ■ and those of a conveying sheet having a configuration shown in FIG. 6 is plotted with a mark ♦.

As is clear from FIGS. 9A to 9E, the amount of conveyed toner decreases gradually as time elapses in the case where the conveying sheet 58 having the openings 60 in accordance with the present invention and hence the conveying sheet 58 like this can not be used for a long period. That is, the amount of conveyed toner decreases gradually as the use of the conveying sheet 58 is elongated. The reason why the amount of conveyed toner decreases is as follows; if the openings 61 are formed close to the tip end portion of the conveying sheet 58 (1.05H), the area of the conveying sheet for scooping and conveying the toner decreases at its tip end portion and can not secure the sufficient amount of conveyed toner; contrarily, if the openings 61 are formed close to the portion where the conveying sheet 58 is fixed to the agitator 57 (0. 45H), the toner pressure applied to the conveying sheet 58 increases to plastically deform the conveying sheet 58 near the end portion where the conveying sheet 58 is fixed to the agitator 57, thereby making it impossible to secure the toner conveyance and gradually decreasing the amount of conveyed toner.

Figure 9A:
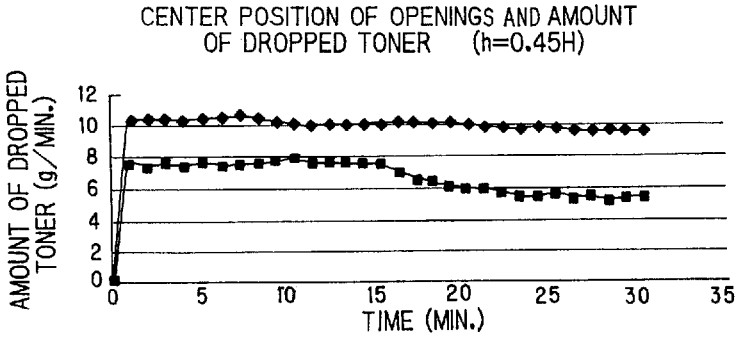
FIGS. 9A to 9E are the characteristic charts showing, for comparison, the results of the amount of conveyed toner with respect to the position of openings when a conveying sheet in accordance with the second preferred embodiment of the present invention was used.
Figure 9B:
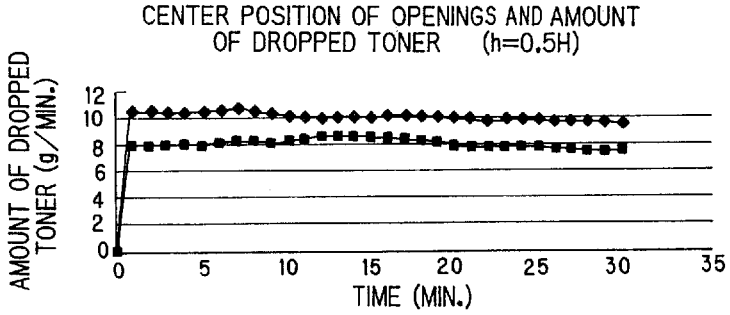
Figure 9C:
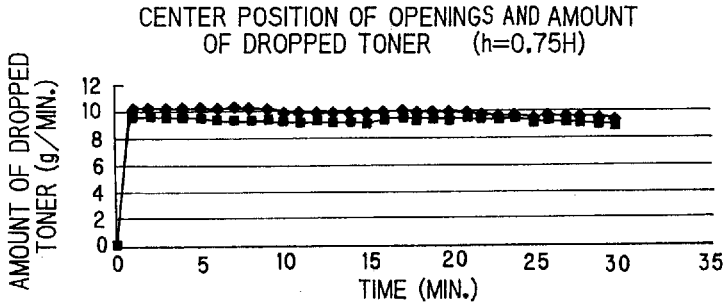
Figure 9D:
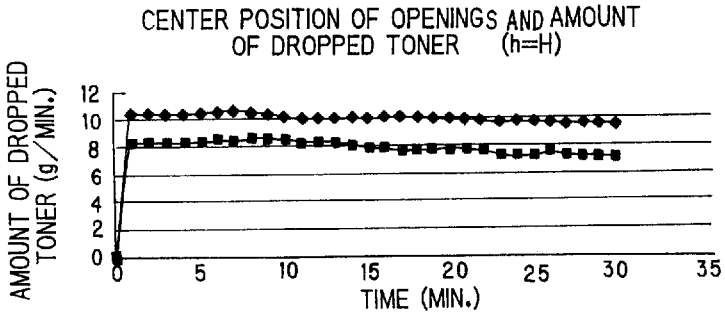
Figure 9E:
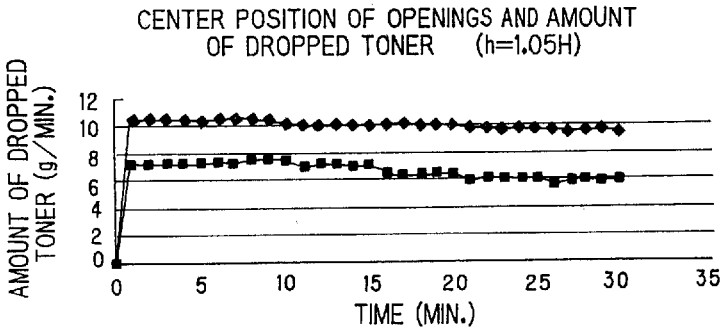

In contrast to this, if the conveying sheet 58 has the openings 61 formed in such a way that the center distance h is 0.5H or 1.0H, as shown in FIGS. 9B or 9D, it is inferior in the amount of conveyed toner to the conveying sheet 58 shown in FIG, 6, but can stably keep a steady, sufficient amount of toner conveyance W for a long time.

For this reason, the positions of the openings 61 are determined in such a way that the center distance h of the group of openings 61 satisfies the relationship of $H/2 \leqq h \leqq H$. If the openings 61 are formed in the range satisfying the relationship described above with respect to this center position O, the conveying sheet 58 can keep a stable, sufficient toner conveyance for a long time.

Also, if conveying sheet 58 has the center distance h of 0.7H, as shown in FIG. 9C, the conveying sheet 58 can keep very excellent toner conveyance for a long time and can secure a larger amount of conveyed toner than the conveying sheet having the configuration shown in FIG. 6. As shown in FIG. 9C, even if the conveying sheet 58 has the center distance h of 0.75H, the conveying sheet 58 can secure the same amount of conveyed toner as the conveying sheet having the configuration shown in FIG. 6 and therefore the optimal center distance h is about 0.7H, or from 0.65H to 0.75H.

Also, although the evaluation was made for the conveying sheet having the openings 61, as described above, this performance is alike with the conveying sheet having the slits 60. Here, the center position O of the slits 60 is the center of only the group of the slits 60 as described above, that is, in FIG. 1, the center position O is at the center in the direction of length L of the center slit 60*c* (if the same number of slits are formed on both sides and the number is odd). Also, if there are two center slits 60*c*, that is, the number of slits 60 are even, the center position O is at the center between the center slits 60*c* and in the direction of length L of the slit.

The slits 60 like this could produce the same results for the center distance h and the same effects as the openings 61 described above.

On the other hand, as described above, in the openings 61, the toner conveyance varies with the opening ratio in addition to the center distance h. Therefore, the results of toner conveyance measured by the use of the conveying sheets having various total areas of the group of openings 61 will be shown in FIGS. 10A to 10E.

The opening ratio Sr is a ratio of the total area Sk of the group of openings 61 to the total area Ss of the conveying sheet 58 shaped like a plane, that is, $Sr=Sk/Ss\times100\%$. Here, for example, in the case where the conveying sheet 58 is curved at its tip end to form a toner holding portion 58*a*, the total area Ss of the conveying sheet 58 is the total area of the conveying sheet 58 in the state of a plane which is calculated by subtracting the toner holding portion 58*a* and the end portion where the conveying sheet 58 is fixed to the agitator 57 from the total area of the conveying sheet 58.

Also, the conveying sheets 58 were substantially equal in thickness and shape to those having the structure shown in FIG. 9 and had five kinds of opening ratios Sr, 5%, 10%, 20%, 30%, and 35%. In this case, the center distance h of the openings 61 was set at 0.7H for all sheets.

The state of toner conveyance by each conveying sheet 58 will be shown in FIG. 10 in comparison with that of the conveying sheet provided with the reinforcing member 45 shown in FIG. 6. As is clear from FIG. 10, if the opening ratio Sr is 5% or 35%, the amount of conveyed toner could not be kept constant for a long time and gradually decreased.

In particular, in the case of the conveying sheet 58 having an opening ratio Sr of 5%, the conveying sheet 58 could not be deformed well, in other words, was slightly deformed to produce large load near the portion where the conveying sheet 58 was fixed to the agitator 57, thereby being plastically deformed at the portion. This largely reduced the elasticity of the conveying sheet 58 and the amount of conveyed toner. Also, in the case of the conveying sheet 58 having an opening ratio Sr of 35%, the conveying sheet 58 was largely deformed by the toner pressure and could not secure sufficient toner conveyance. Further, the toner apparently leaked from the openings 61 and the amount of conveyed toner was reduced as a whole.

Figure 10A:
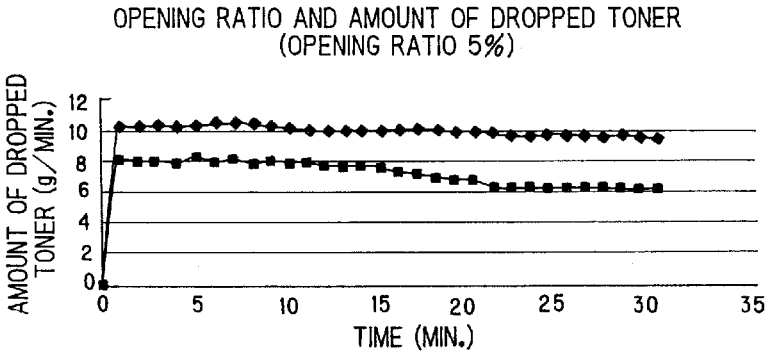
FIGS. 10A to 10E are the characteristic charts showing, for comparison, the results of the amount of conveyed toner with respect to the opening ratio of openings when a conveying sheet in accordance with the second preferred embodiment of the present invention was used.
Figure 10B:
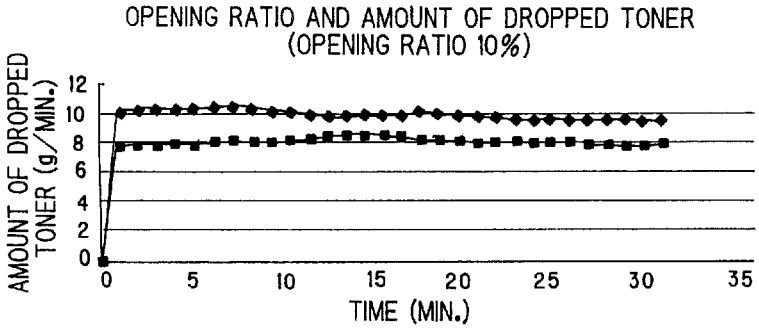
Figure 10C:
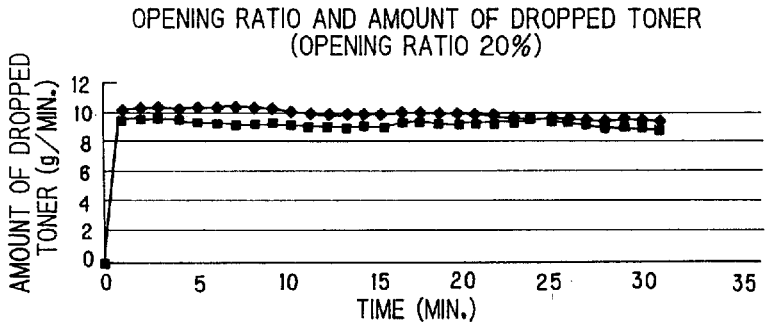
Figure 10D:
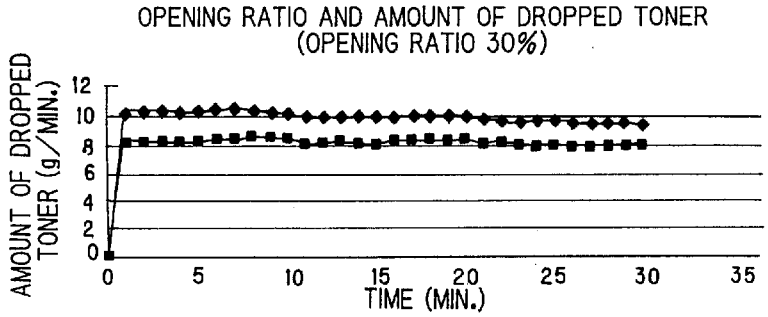
Figure 10E:
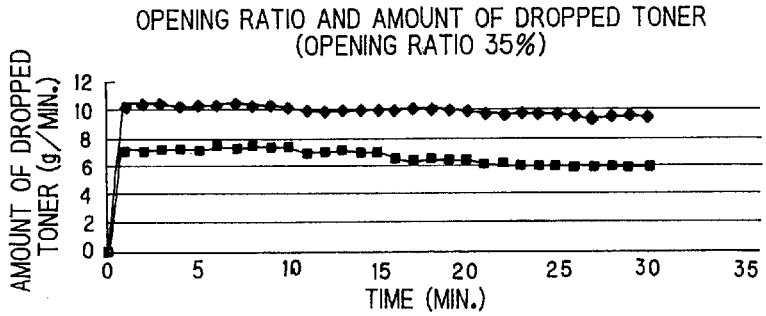

Therefore, it is most suitable to set the opening ratio Sr of the openings 61 at from 10% to 30%. The conveying sheet 58 having an opening ratio of 25% produced the same or more effect as the conveying sheet 58 provided with the reinforcing member 45 shown in FIG. 6. For this reason, it is most suitable that the opening ratio Sr is set at about 25% and, as shown in FIG. 10C, the conveying sheet having an opening ratio Sr of about 20% could produce the approximately same effect as the conveying sheet having the configuration shown in FIG. 6.

In this manner, if the opening ratio Sr of the openings 61 formed in the conveying sheet 58 is set within the range described above, the conveying sheet can have strength to keep the stable toner conveyance for a long time.

Further, if the opening ratio Sr and the center distance h are set within the range described above, they can be used as the references for determining the size and the number of the openings 61 to be formed in the conveying sheet 58. In other words, if the center distance h is determined, it is possible to suitably determine the number of openings 61 to be formed based on the center position O for the center distance h and the shape thereof in accordance with the opening ratio Sr.

According to the toner replenishing device described above, the conveying sheet for conveying the toner can be made thicker by forming the slits or the openings in the conveying sheet so as to hold the rigidity and strength of the conveying sheet, thereby eliminating the need for providing the conveying sheet with the reinforcing member, which results in making the constitution thereof very simple.

Further, since the toner conveyance can be kept only by the conveying sheet, the constitution relating to the toner conveyance can be made very simple, making the conveying sheet be used for a long time and reducing manufacturing costs.

Still further, if the positions and shapes of the slits or the openings formed in the conveying sheet are suitably determined, the conveying sheet can keep the amount of conveyed toner and the stable toner conveyance for a sufficiently long time.

From the results described above, since the developing unit is provided with the toner replenishing device in accordance with the present invention, it can always secure stable toner conveyance and can keep stable image quality.

What is claimed is:

1. A toner replenishing device comprising:

a toner conveying unit for agitating and conveying toner stored in a toner reserve container, the toner conveying unit including an agitator for rotating the toner stored in the toner reserve container, and a conveying sheet for conveying the toner, fixed to an end portion of the agitator, wherein the conveying sheet has a plurality of slits, the slits extending in only one direction, physically spaced by a first distance, from a base end of the conveying sheet and physically spaced from a tip end of the conveying sheet by a second distance which is greater than the first distance.

2. A toner replenishing device as set forth in claim 1, wherein the slits are made gradually smaller from a center portion to side portions of the conveying sheet which is in the direction of a rotary shaft of the agitator.

3. A toner replenishing device as set forth in claim 1, wherein the slits are formed so that a center distance h between a center position of the agitator in the direction at a right angle to a rotary shaft of the agitator and a center position of the plurality of slits in the direction at a right angle to the rotary shaft of the agitator and the shortest distance H between the end portion of the agitator and a bottom of the toner reserve container satisfy a relationship of $0.5H \leqq h \leqq H$.

4. A toner replenishing device comprising:

a toner conveying unit for agitating and conveying toner stored in a toner reserve container, the toner conveying unit including an agitator for rotating the toner stored in the toner reserve container and a conveying sheet with a plurality of slits conveying the stored toner fixed to an end portion of the agitator, and the slits are formed in a direction of the extension of the conveying sheet from a base end portion which is where the conveying sheet is fixed to the agitator to a tip end of the conveying sheet, wherein the slits are formed at pitches which become gradually larger from a center portion of the conveying sheet to both side portions of the conveying sheet in a direction of a rotary shaft of the agitator.

5. A toner replenishing device as set forth in claim 4, wherein the slits are made gradually smaller from the center portion to the side portions of the conveying sheet which are in the direction of the rotary shaft of the agitator.

6. A toner replenishing device comprising a toner conveying unit for agitating and conveying toner stored in a toner reserve container, the toner conveying unit including an agitator for rotating the toner stored in the toner reserve container and a conveying sheet with a plurality of openings formed close to an end portion of the agitator where the conveying sheet is fixed to the agitator, the conveying sheet conveying the toner, wherein the plurality of openings have the same shape and the same opening area and are formed at pitches which become gradually larger from a center portion to both side portions of the conveying sheet in a direction of a rotary shaft of the agitator.

7. A toner replenishing device comprising a toner conveying unit for agitating and conveying toner stored in a toner reserve container, the toner conveying unit including an agitator for rotating the toner stored in the toner reserve container and a conveying sheet with a plurality of openings formed close to an end portion of the agitator where the conveying sheet is fixed to the agitator, the conveying sheet conveying the toner, wherein the plurality of openings have the opening areas which become gradually smaller from the centers portion to both side portions of the conveying sheet in a direction of a rotary shaft of the agitator.

8. A toner replenishing device comprising a toner conveying unit for agitating and conveying toner stored in a toner reserve container, the toner conveying unit including an agitator for rotating the toner stored in the toner reserve container and a conveying sheet with a plurality of openings formed close to an end portion of the agitator where the conveying sheet is fixed to the agitator, the conveying sheet conveying the toner, wherein the openings are formed so that a center distance h between a center position of the agitator in a direction at a right angle to a rotary shaft of the agitator and a center position of the plurality of openings in the direction at a right angle to the rotary shaft of the agitator and the shortest distance H between the end portion of the agitator and a bottom of the toner reserve container satisfy a relationship of $0.5H \leqq h \leqq H$.

9. A toner replenishing device comprising:

a toner conveying unit for agitating and conveying toner stored in a toner reserve container, the toner conveying unit including an agitator for rotating the toner stored in the toner reserve container and a conveying sheet with a plurality of openings conveying the stored toner fixed to an end portion of the agitator, wherein the plurality of openings are formed so that an opening ratio Sr of a total opening area Sk of the plurality of openings to a total area Ss of the conveying sheet ($Sr=Sk/Ss \times 100\%$) is set at a range from 10% to 30%.

* * * * *